US007276018B2

(12) United States Patent
Studdard

(10) Patent No.: US 7,276,018 B2
(45) Date of Patent: Oct. 2, 2007

(54) RECLINING EXERCISE CHAIR

(75) Inventor: Steve B. Studdard, Atlanta, GA (US)

(73) Assignee: Steven Boyd Studdard, Atlanta, GA (US)

( * ) Notice: Subject to any disclaimer, the term of this patent is extended or adjusted under 35 U.S.C. 154(b) by 277 days.

(21) Appl. No.: 10/269,692

(22) Filed: Oct. 12, 2002

(65) Prior Publication Data

US 2003/0087737 A1 May 8, 2003

Related U.S. Application Data

(60) Provisional application No. 60/329,341, filed on Oct. 15, 2001.

(51) Int. Cl.
*A63B 26/00* (2006.01)

(52) U.S. Cl. ..... 482/142; 482/92; 482/95; 482/121; 482/122; 482/129

(58) Field of Classification Search ..... 482/142, 482/92, 95–96, 101–102, 121–131, 112, 148, 482/140

See application file for complete search history.

(56) References Cited

U.S. PATENT DOCUMENTS

| | | | | |
|---|---|---|---|---|
| 1,973,945 | A | 9/1934 | Chavin et al. | |
| 2,786,512 | A | 3/1957 | Moyer | |
| 4,921,247 | A | 5/1990 | Sterling | |
| 5,611,758 | A | 3/1997 | Rodgers, Jr. | |
| 6,090,022 | A * | 7/2000 | Colecchi | 482/131 |

* cited by examiner

*Primary Examiner*—Lori Amerson

(57) ABSTRACT

An exercise chair with a base frame with upright sides that support a pivoting backrest with a pivoting left arm and a pivoting right arm and a seat therein, with pivotally coupled leg members all that function sitting up or lying down. Each arm member has a reciprocating handle and each leg member has foot pegs. Resistance is provided to each member by being pivotally coupled to bidirectional resistance hydraulic cylinders. The rear side of the backrest has pivotally attached, laterally, telescoping arms, each supporting a floating pulley with a cable looped through it with one end of the cable connected to a system of pulleys with spring resistance, and the other end of the cable, having a handle that can be pulled by the users hands or extended to the feet.

17 Claims, 10 Drawing Sheets

RECLINING EXERCISE CHAIR

CROSS-REFERENCE TO RELATED APPLICATION

This application is entitled to the benefit of Provisional Patent Application Ser. No. 60/329,341 filed Oct. 15, 2001.

BRIEF SUMMARY/BACKGROUND OF THE INVENTION

A reclining chair with exercise components so as to allow the user to sit or lay down comfortably and perform a multitude of exercises for their arms, legs, chest, back and abdominal region, yet minmizes impact to critical joints. An adjustable base frame supports a pivoting seat and pivoting backrest beams. The pivoting seat beams support pivoting leg beams that serve as a footrest when user chooses to relax and serve as leg exercise members when one is exercising by placing their ankles in between the front and rear mounted pegs located within the footrest mechanism and raising and lowering one or both leg members which are connected to a means of adjustable *bidirectional resistance, thus exercising the front and rear of the thigh muscles or allowing leg members to rest in a horizontal position on the footrest support levers located at the top rear of each leg beam when the user chooses to relax. Attached to the backrest beams are pivoting arm members that are connected to a means of adjustable bidirectional resistance so that the user can move arm members up and down to provide exercise for the biceps and triceps of the arm. The arm members also provide reciprocating handles connected to linkage and a means of adjustable bidirectional resistance that allow handles to be moved forward and backward, providing exercise for the chest and back muscles. The handles can also be moved forward and down, back and up, or in the other direction, back and down, forward and up, thus creating a circular motion like when one is swimming. Also attached to the backrest beams are handles that can be pulled out from behind the backrest so that they can swing out laterally from the top area of the backrest, down to each side of the chair, and are connected to cables threaded through a system of pulleys and are recoiled therein, thus allowing user to pull handles in a multitude of directions including forward and down for exercising the triceps, chest, and abdominals, as well as pulling the handles from the side, crossing over the chest, exercising the chest and biceps. Hold down hooks are provided, to secure the handle supports at the side position, allowing the handles to be pressed upward in a multitude of directions, providing exercises for the deltoids, trapezius, and triceps muscles. Each handle can be extended to reach the users foot, allowing a multitude of leg exercises, such as scissor kicks, stair stepping, and lateral thigh splits, thus providing exercises for various parts of the thigh and buttocks as well as toe raises for exercising the calves. Spinal rollers can be inserted between each backrest beam in a vertical slot in the lower middle section of the backrest cushion in which the spinal rollers roll up and down the users spinal region when the backrest is raised and lowered. After exercising, the lateral handles can be replaced behind the backrest, out of sight.

*note: bidirectional resistance=a hydraulic cylanders

FIG. 1 is a perspective view taken from the users left side of a reclining chair constructed in accordance with the invention. Square tubing is used for all major components of the construction including a frame, seat, backrest, arms, legs, and, lateral segments.

The frame consists of a left base beam 10*a.*, a right base beam 10*b.*, a rear base beam 10*c.*, a middle base beam 10*d.*, a left front verticle beam 10*e.*, right front vertical beam 10*f.*, a left frame arm 10*g.*, a right frame arm 10*h.*, left rear diagonal strut 10*i.*, right rear diagonal strut 10*j.* The entire structure is supported by four casters (swiveling wheels) located on the bottom of each corner of the frame.

A set of two backrest beams 34*l.&r.* are held up by a backrest pivot/support rod 58 that connects through adjustment holes in both rear diagonal struts 10*i.* and 10*j.* that can slide forward and back, and through the adjustment holes in the backrest beams 34*l.&r.* A lower backrest seat support rod 30 passes through the bottom of the backrest beams 34*l.& r.* and has several adjustable wire rope cables 32 hanging down connecting to a rear seat pivot/support rod 28 that connects to and supports the rear of seat beams 20*l.& r.* Seat beam roller support 26 *l.& r.*, that is supported by vertical beams 10*e.* and 10*f.*, supports the front of the seat beams 20*l.& r.*

A forward seat pivot/support rod 24 is positioned through the front of the seat beams 20*l.& r.* which acts as a pivot for leg beams 40*l.& r.* At the bottom front of the leg beams 40*l.& r.*, is a front ankle roller peg 46*l.& r.* At the bottom rear of each leg beam 40*l.& r.* is a rear ankle roller peg 47*l.& r.* Rear ankle roller peg 47*l.& r.* is slightly higher than front ankle roller peg 46*l.& r.* Inside of leg beam 40*l.& r.* is a leg press spring 45*l.& r.* One end of the leg press spring 45*l.& r.* is connecting to the forward seat pivot/support rod 24 and the other end of the leg press spring 45*l.& r.* is connecting to the leg press shaft pedal 44*l.& r.* which is inside the leg press spring 45*l.& r.* A leg beam flange 42*l.& r.* with adjustment holes is attached to the back of the leg beam 40*l.&r.* One end of a shock absorber 33*a.& b.* is connected to any of the adjustment holes in the leg beam flange 42*l.& r.* and the other end of shock absorber 33*a.& b.* is connected to any of the holes in seat beam flange 22*l.& r.* that is attached to the bottom of seat beam 20*l.& r.* Connected to the upper part of leg beam flange 42*l.& r.* is a leg beam support lever 48*l.&r.*

A pivoting arm beam support rod 57 is inserted through both backrest beams 34*l.& r.* to provide a pivoting support for arm beam 50*l.& r.* which contains a push/pull shaft 52*l.& r.* which is sandwiched in between upper and lower roller/stabilizers 53*a* and 53*b.*, located at the front end of arm beam 50*l.& r.*

At the front end of push/pull shaft 52*l.& r.*, is a swivel handle 54*l.& r.* Just before the front end of push/pull shaft 52*l.& r.*, is a connecting rod 55*l.& r.* The front end of the connecting rod 55*l.& r.*, is at the front of push/pull shaft 52*l.& r.* The rear of connecting rod 55*l.& r.* is connected to the bottom end of adjustment lever 56*l.&r.* One end of shock absorber 33*c.& d.* is connected to any adjustment holes in the adjustment lever 56*l.&r.* The other end of shock absorber 33*c.& d.*, is connected to any holes toward the rear of arm beam flange 51*l.& r.* that is attached to the bottom rear of arm beam 50*l.& r.* One end of another shock absorber 33*e.& f.* is connected to any desired adjustment hole toward the front of same arm beam flange 51*l.& r.* The other end of same shock absorber 33*e.& f.*, is connected to the rear seat pivot/support rod 28.

FIG. 4 is a back view of same invention displaying a lateral lever 60*l.& r.* that is connected to the back of each backrest beam 34*l.& r.*, just slightly higher than pivoting arm beam support rod 57. Connecting to same pivoting support rod 57 is a hold down hook 61*l.& r.* At the outer end of the lateral lever 60*l.& r.* is a universal joint 63*l.& r.*, in part with a connecting link 64*l.& r.*, that is holding a multi-directional pulley 62*l.&r.* Same multi-directional pulley 62*l.& r.*, has a wire rope cable 32*l.*& *r.* passed through multidirectional pulley 62*l.*& *r.* with a loop handle 69*l.*& *r.* at the outer end of wire rope cable 32*l.*& *r.,* and the other end of same wire rope cable 32*l.*& *r.* passes through a pivoting cable guide 64*a.* and then to a larger wheel of a step pulley 65*l.*& *r.* A small wheel of same step pulley 65*l.*& *r.* has a wire rope cable 32*a.* connected to same small wheel of same step pulley 65*l.*& *r.* that connects to the top of a lateral lever mainspring 66*l.*& *r.* The bottom of same lateral lever mainspring 66*l.*& *r.* is connected at the bottom of each backrest beam 34*l.*& *r.* At the top of each backrest beam 34*l.*& *r.,* on the inner side of each backrest beam 34*l.*& *r.* is a connection for a lateral lever return counterspring 67*l.*& *r.* and an adjustable turnbuckle 68*l.*& *r.* Both backrest beams 34*l.*& *r.* support a backrest cushion 39 on the front of each backrest beam 34*l.*& *r.* On top of each seat beam 20*l.*& *r.* is a seat cushion 38.

Operation

In operation one uses a reclining exercise chair in the same manner as with any reclining furniture, i.e., home leisure, or office work etc. In addition to the usual relaxation benefits of such a chair, exercises for arms, legs, and torso may be performed while sitting or lying in the above described invention.

Starting with leg beam(s) 40*l.*& *r.,* user may, whilst sitting as one would in any chair, slip their ankles in between both front and rear foam roller covered ankle roller pegs 46*l.*& *r.* and 47*l.*& *r.* Then by performing a forward movement of either or both feet, with legs pivoting at the knees, either or both leg beams 40*l.*& *r* may be raised until legs are extended to a straight out position. This action pulls out and extends shock absorber 33*a.*& *b.* which is connected to the leg beam flange 42*l.*& *r.* and the seat beam flange 22*l.*& *r.* Shock absorber 33*a.*& *b.* provides resistance in both directions so as to provide exercise for front thigh muscles (vastus medialis, and vastus lateralis), when leg beam 40*l.*& *r.* is pivoting forward, and provides exercise for the rear thigh muscles (biceps femoris) when pivoting in the return direction. While leg beam 40*l.*& *r.* is in forward or up position, a leg beam support lever 48*l.*& *r.* may be swung back to hold up leg beam 40*l.*& *r.* so as to employ leg press feature by placing users foot on leg press shaft/pedal(s) 44*l.*& *r.* and pushing out forward, extending the leg(s) thus engaging the leg press spring 45*l.*&*r.,* providing exercise for additional front thigh muscles (quadriceps femoris), as well as buttocks muscles (gluteus maximus), or by pivoting ankles against leg press shaft/pedal(s) 44*l.*& *r.,* the calf muscles (gastrocnemius) may be exercised. Placing users feet on the front ankle roller peg 46*l.*& *r.,* of extended leg beam 40*l.*& *r.,* allows leg beam 40*l.*& *r.* to be used as a footrest.

Arm beams 50*l.*&*r.* may provide exercise for both front upper arm muscles (biceps) and for rear upper arm muscles (triceps). By grasping swivel handle 54*l.*&*r.,* user may press down or pull up arm beam(s) 50*l.*&*r.* simultaneously or alternating each arm up and down. When pressing down on the swivel handle 54*l*&*r.,* the pivoting arm beam support rod 57 acts as a fulcrum so that the rear of arm beam 50*l.*&*r.* pivots up. Resistance is created by shock absorber 33*e.*&*f.* that is connected to any of the forward adjustment holes in arm beam flange 51*l.*& *r.* at one end of shock absorber 33*e.*& *f.,* while other end of shock absorber 33*e.*& *f.* is connected to rear seat pivot support rod 28*l.*& *r.* when same shock absorber 33*e.*& *f.* is pulled out. This pressing down movement provides exercise for the rear upper arm muscles (triceps). When swivel handle 54*l.*& *r.* is pulled upward, same pivoting arm beam support rod 57, again acts as a fulcrum so that the rear of arm beam 50*l.*& *r.* pivots down. When this action occurs, shock absorber 33*e.*& *f.* is pushed in, again creating resistance. This upward movement provides exercise for the front upper arm muscles (biceps). Resistance may be increased or decreased by either connecting shock absorber 33*e.*& *f.* to another adjustment hole in the arm beam flange 51*l.*& *r.,* or by using swivel handle 54*l.*& *r.* to move push/pull shaft 52*l.*& *r.* in or out to change the leverage, (when rocking arm beam 50*l.*& *r.* up or down) so as to increase or decrease resistance when pressing down or pulling up on the swivel handle 54*l.*& *r.* accordingly.

By pressing forward on swivel handle 54*l.*& *r.,* push/pull shaft travels forward coming outside of arm beam 50*l.*& *r.* The push/pull shaft 52*l.*& *r.* is guided in the proper position by the upper and lower roller/stabilizers 53*a.*& *b.* located at the front of arm beam 50*l.*& *r.* As push/pull shaft 52*l.*& *r.* travels forward, it pulls connecting rod 55*l.*& *r.* forward which pulls adjustment lever 56*l.*& *r.* forward. Adjustment lever 56*l.*& *r.* pulls out and extends shock absorber 33*c.*& *d.* This pressing out movement provides exercise for the chest muscles (pectoralis major, and pectoralis minor) as well as triceps.

When swivel handle 54*l.*& *r.* is pulled back toward user, push/pull shaft 52*l.*& *r.* travels inside arm beam 50*l.*& *r.* Connecting rod 55*l.*& *r.* is pushed backward thus pushing adjustment lever 56*l.*& *r.* backward. Adjustment lever 56*l.*& *r.* then pushes end of shock absorber 33*c.*& *d.* inward. Resistance can be increased or decreased by connecting front of shock absorber 33*c.*& *d.* to another adjustment hole in adjustment lever 56*l.*& *r.* This rowing motion provides exercise for the users back muscles (latissimus dorsi), as well as biceps and can be performed with arm beam 50*l.*& *r.* in any of the up or down positions.

Arm beam 50*l.*& *r.* can be rocked up and down while simultaneously pulling inward or pushing outward, on the swivel handle 54*l.*& *r.* to create a circular or semi-circular motion, as if swimming.

Lateral lever 60*l.*& *r.* has a pivot slightly above the half way point measuring upward from the bottom on the back of each backrest beam 34*l.*& *r.* This pivot allows lateral lever 60*l.*& *r.* to travel from top of backrest beam 34*l.*& *r.* to a horizontal position on the side that it is mounted. The user may pull loop handles 69*l.*& *r.* from either position or pull loop handles 69*l.*& *r.* while lateral lever 60*l.*& *r.* is in motion. When loop handles 69*l.*& *r.* are pulled from either starting position, a wire rope cable 32*l.*& *r.* that is traveling through a multi-directional pulley 62*l.*& *r.* and through a pivoting cable glide 64*a.,* unwinds from around a large wheel of a step pulley 65*l.*& *r.* which rotates a small wheel of same step pulley 65*l.*& *r.* causing another wire rope cable 32*a. l.*& *r.* to wind around same small wheel of same step pulley 65*l.*& *r.,* creating resistance by pulling lateral lever mainspring 66*l.*& *r.* When loop handles 69*l.*& *r.* are returned toward starting positions, lateral lever counterspring 67*l.*& *r.* prevents lateral lever 60*l.*& *r.* from an abrupt return.

Pulling loop handles 69*l.*& *r.* forward from top position by bending arms at elbow and pressing forearms in a forward direction, provides exercise for the triceps muscles and/or pulling loop handles 69*l.*& *r.* forward and down in an arc motion, will provide exercise for the back muscles (latissimus dorsi) and lower region of the pectoral muscles.

By holding loop handles 69*l.*& *r.* at the shoulders while user bends torso forward in a bowing action (curling the spine) with shoulders lowering toward users thighs, pulling loop handles 69*l.*& *r.* in this manner, provides exercise for abdominal muscles and intercostals.

By placing lateral lever 60*l.*& *r.* in a horizontal position and swinging up and engaging hold down hook 61*l.*& *r.,* the lateral lever 60*l.*& *r.* may be held in a stationary position to perform exercises by pulling forward for chest, up for shoulders (deltoids), down or across users torso, providing exercises for pectoral muscles and triceps in any variety of angles by pulling loop handles 69*l.*& *r.* in any direction that the user chooses.

An additional exercise can be performed with lateral lever 60*l.*& *r.* in the horizontal position by holding loop handles 69*l.*& *r.* near hips and rotating torso (with loop handles 69*l.*& *r.* traveling along with torso) in a clockwise direction, then alternating to a counterclockwise direction etc., this action provides exercise for the external obliques.

ALTERNATIVE EMBODIMENTS

FIG. 5 is a perspective view taken from the users left side of same reclining chair constructed in accordance with the above described invention.

DESCRIPTION—SPINAL ROLLER ASSEMBLY

Spinal roller assembly 72 may be installed in between backrest beams 34*l.*& *r.,* supported by spindle rods in the mid to lower region of same backrest beams 34. Each spinal roller 72 can be of foam or of other therapeutic material.

Operation—Spinal Roller Assembly

Spinal roller assembly 72 may be used to massage users mid-back and lumbar region by placing feet in between front ankle roller peg 46*l.*& *r.* and rear ankle roller peg 47*l.*& *r.* and locking leg beams 40*l.*& *r.* in the extended position, then leaning torso back into a reclining position, and then returning to a sitting position, causing spinal rollers to roll up and down users spine. If user chooses not to use massage feature, simply place feet on top of front ankle roller peg 46*l.*& *r.* and lean torso back into a reclining position, then spinal rollers 72 remain stationary, supporting users back.

Description—Leg Raise Attachment

Leg raise attachment 74*l.*& *r.* consists of an angled shaft extending upward with a footrest and a foot harness bracket above footrest at the top, with grommet support brackets at the bottom. Leg raise attachment 74*l.*& *r.* can be placed in a perpendicular position on lower leg beam 40*l.*& *r.* by placing grommet of same leg raise attachment 74*l.*& *r.* over front and rear ankle roller pegs 46 and 47*l.*& *r.* Grommet holes may be large enough to fit over foam rollers on front and rear ankle roller pegs 46 and 47*l.*& *r.* Grommet support bracket that attaches to rear ankle roller peg 47*l.*& *r.* has pivoting capability for adjusting to each users leg length and to attach a spring or shock absorber from leg beam 40*l.*& *r.,* to leg raise attachment 74*l.*& *r.* so that leg raise attachment 74*l.*& *r.* can pivot at front ankle roller peg 46*l.*& *r.* to provide exercise for leg(s) in both directions.

Operation—Leg Raise Attachment

Leg raise attachment 74*l.*& *r.,* when attached to ankle roller pegs 46 and 47*l.*& *r.* is utilized by user placing their foot on footrest with foot harness bracket covering same foot, then extending leg(s) forward and upward, then back toward self, creating an arc motion. This arc motion provides exercise for upper upper quadriceps (rectus femoris) and lower abdominal region (adductor longus). Then pressing forward and down on footrest in an arc motion provides exercise for buttocks muscles (gluteus maximus) and upper rear thigh muscles (semimembranosus).

Description—Slip Knee Joint

Slip knee joint 76*l.*& *r.* consists of a slotted sliding leg beam support bracket attached to top and each side of leg beams 40*l.*& *r.* with forward seat pivot/support rod 24 passing through slot of same slotted sliding leg beam support bracket. Top of rear leg beams 40*l.*& *r.* has an open slot which fits over forward seat pivot/support rod. The purpose of slip knee joint 76*l.*& *r.* is to allow pivot point of leg beam(s) 40*l.*& *r.* to become aligned with users knee so as to more directly effect rear thigh muscles.

Operation—Slip Knee Joint

On return stroke of leg beam(s) 40*l.*& *r.*, (after leg beam(s) 40*l.*& *r.* have been extended), top of same leg beam(s) slip(s) forward and out of forward seat pivot/support rod 24 and is guided by slotted sliding leg beam support bracket. When the above described action occurs, connection point where shock absorber 33*a.* and/or shock absorber 33*b.* connects with leg beam flange 42*l.*& *r.*, acts as a fulcrum as leg beam 40*l.*& *r.* is returned to starting position.

Description—Curved Lateral Lever

Lateral lever 60*l.*& *r.* can be convex or concave at top, bottom, or middle of same lateral lever 60*l.*& *r.*

Operation—Curved Lateral Lever

Lateral lever 60*l.*& *r.* may be curved in such a manner so as to conform to any curvature of the outer side edge of backrest cushion 39.

Description—Track for Multidirectional Pulley

Track 80*l.*& *r.* for multidirectional pulley 62*l.*& *r.* consists of a track 80*l.*& *r.* that is curved from top of backrest beams 34*l.*& *r.* to midsection of same backrest beams 34*l.*& *r.* and contains multidirectional pulley 62 *l.*7 *r.* held within track 80*l.*& *r.* by a roller.

Operation—Track for Multidirectional Pulley

When loop handles 69*l.*& *r.* are pulled laterally, roller that holds multidirectional pulley 62*l.*& *r.*, travels along inside track 80 that is curved to conform to the curvature of the outer edges of backrest cushion 39.

Description—Toe Rest

A platform attached to a square tube that fits into outer end of leg press shaft pedal 44*l.*& *r.*, so that same platform protrudes forward and perpendicular to same leg press shaft pedal 44*l.*& *r.*

Operation—Toe Rest

When leg beam(s) 40*l.*& *r.* is/are locked in extended position, with toe rests 82*l.*& *r.* installed, allows user to press ball of foot against same toe rest 82*l.*& *r.* by pivoting ankles in both directions, providing exercise for calf muscles (gastrocnemius).

Description—Electric Motor/Crank Assembly

Electric motor(s) with crank 84 can replace any shock absorber 33*a.–f.* (and shock absorber 87) by installing same electric motor and crank assembly 84 to same fastening points of shock absorber(s) 33*a.–f.* (and shock absorber 87) that is being replaced. Each motor can have an independent circuit connected to a remote control.

Operation—Electric Motor/Crank Assembly

Electric motor(s) with crank assembly 84 can activate movement of arm beam(s) 50*l.*& *r.*, leg beam(s) 40*l.*& *r.*, backrest beams 34*l.*& *r.* in both directions while being independently controlled by user.

Description—Hydraulic/Neumatic Pump

Hydraulic or neumatic pump 85 can be installed and connected to active hydraulic cylanders in place of current passive shock absorbers 33*a.–f.* and 87 and be independently connected to a remote control.

Operation—Hydraulic/Neumatic Pump

Hydraulic or neumatic pump 85 can activate movement of arm beam(s) 50*l.*& *r.*, leg beam(s) 40*l.*& *r.*, and backrest beams 34*l.*& *r.* in both directions while being independently controlled by user.

Description—Leg Beam Hand Lever

Leg beam hand lever 86 can be installed on outside of top leg beams 40*l.*& *r.* by placing two fasteners through front base of leg beam hand lever 86*l.*& *r.* with hand grip end of same lever toward rear of chair.

Operation—Leg Beam Hand Lever

Leg beam hand lever 86*l.*& *r.* may be employed by user pushing down on hand grip end of same lever 86*l.*& *r.* causing leg beam(s) 40*l.*& *r.* to rise, to be used as a footrest. Then, pulling up on same lever 86*l.*& *r.*, leg beam(s) 40*l.*& *r.* will lower toward starting position.

Description—Backrest Shock Absorber

Shock absorber 87 connects from lower backrest seat support rod 30 to rear base beam 10*c.* of frame.

Operation—Backrest Shock Absorber

Shock absorber 87 provides resistance to backrest beams 34*l.*& *r.* when user pushes same backrest beams 34*l.*& *r.* into a reclignig position, providing exercise for lower back muscles (spina erectus) or lumbar region. Shock absorber 87 also provides resistance to backrest beams 34*l.*& *r.* when user raises backrest beams 34*l.*& *r.* toward upright position, providing exercise for abdominal muscles and intercostals.

CONCLUSION, RAMIFICATONS, AND SCOPE

Thus the reader will see that the reclining exercise chair of the invention provides a highly versatile, convenient, yet space saving apparatus that can be used by persons of almost any age.

While my above description contains many specifities, these should not be construed as limitations on the scope of the invention, but rather as an exemplification of one preferred embodiment thereof. Many other variations are possible. For example, in the medical field, the above described invention could be used in physical therapy, geriatrics, muscle and cardiovascular testing, and exercises can be performed off of the chair by facing the seat and backrest, placing the feet under the front footrest pegs, grasping the lateral cabled handles, then squatting, thus providing a comfortable stretch for the spinal region. Then, standing up, bracing knees on front of seat cushion, and pulling the same handles, exrcises the lumbar region, latissismus dorsi, and the biceps.

In military applications, such as common circumstances when military sevice personnel are confined in close quarters, such as submarines, ships at sea, long air trips, and there is little room for any gym like equipment, then, an adaptation of, or certain components of this invention can be arranged or modified to conform to any of these space limited environments. Astronauts can also benefit from the advantages offered here due again to the space saving capabilities and the ability to easily function in a weight-less environment and provide a possible improvement over the bicycle pedals and T-handle spring that the astronauts are currently using.

Accordingly, the scope of the invention should be determined not by the embodiment(s) illustrated, but by the appended claims and their legal equivalents.

DRAWINGS

Figure 3:
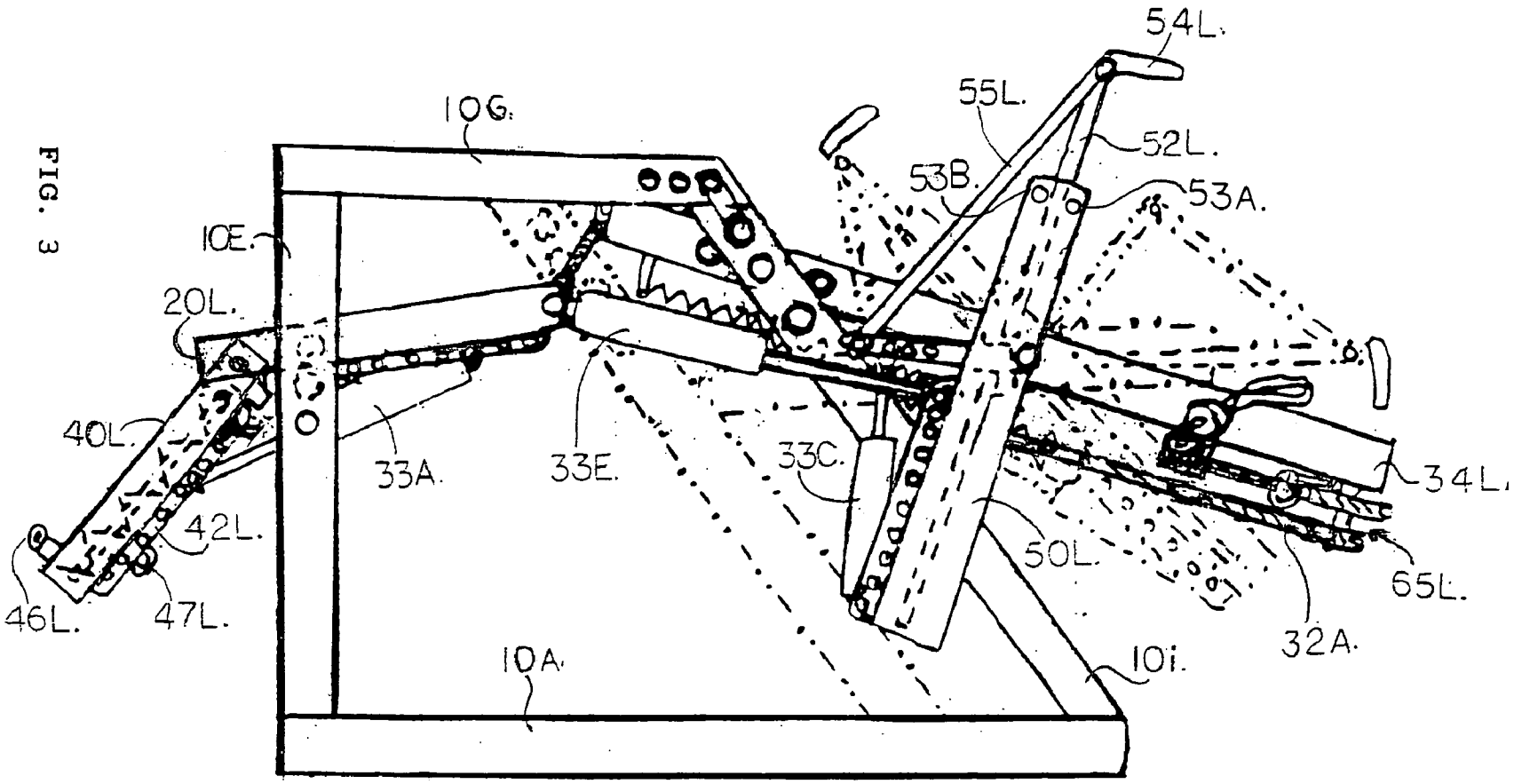

FIG. 3 is a side view taken from users left side of same invention. The backrest is shown in the reclining position, while displaying up and down positions of arm beams. The leg beam(s) is/are shown in both up and down positions while leg beam in the up position is demonstrating the leg press shaft in the extended position. Rear diagonal strut is displaying forward and back positions.

Figure 4:
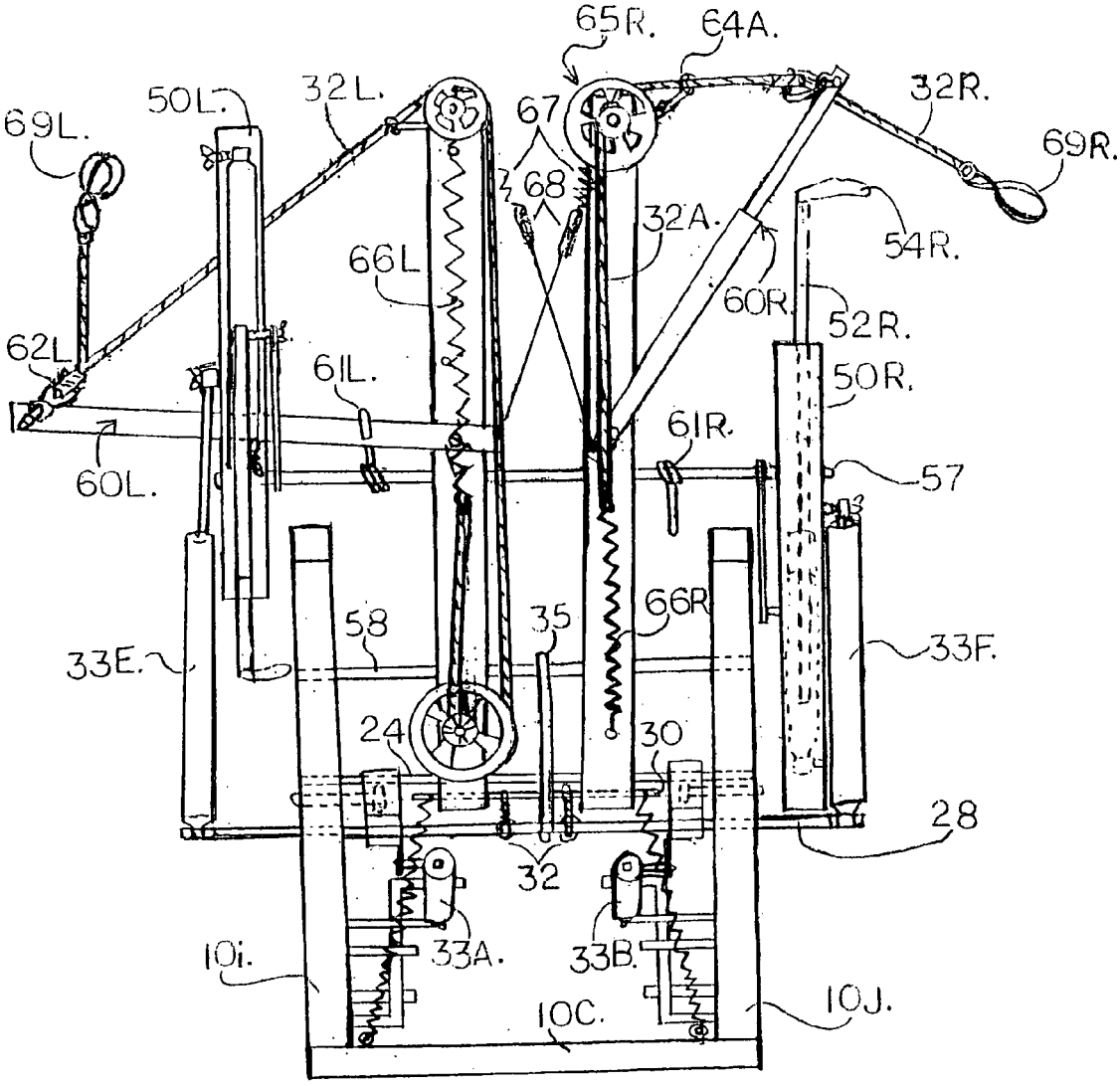

FIG. 4 is a rear view of same invention. (Note that left arm of chair (located at left of FIG. 4) is in the down position, and the right arm of chair (located at right of FIG. 4) is in the up position). Note also that right lateral lever is shown with telescoping capability while left lateral lever is shown being held in a horizontal position by the hold down hook and both lateral levers and both loop handles are displaying their various positions. The step pulley configuration is displaying two different ways it can be constructed and two ways same step pulley may be wound; overshot, or undershot.

Figure 5:
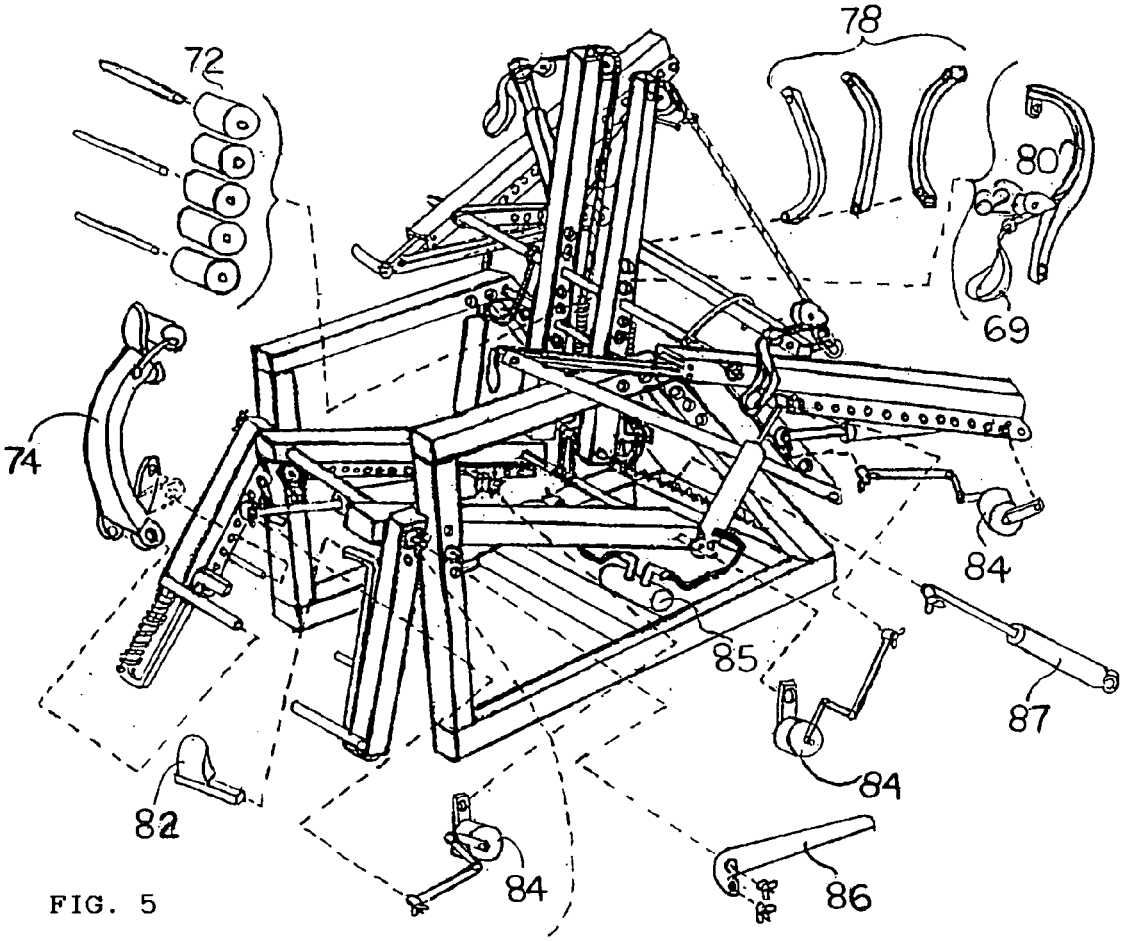
Figure 6:
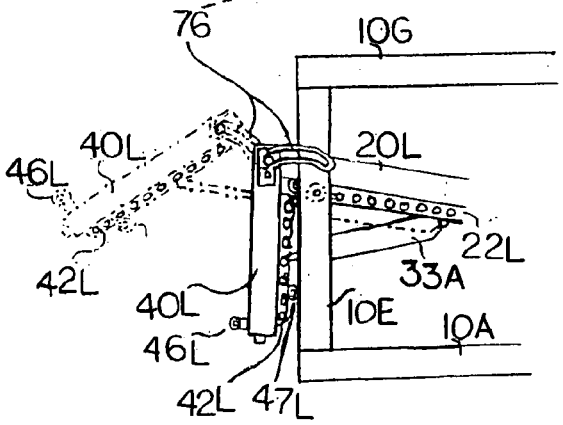

FIGS. 5 and 6 are of Alternative Embodiments accordingly.

Figure 7:
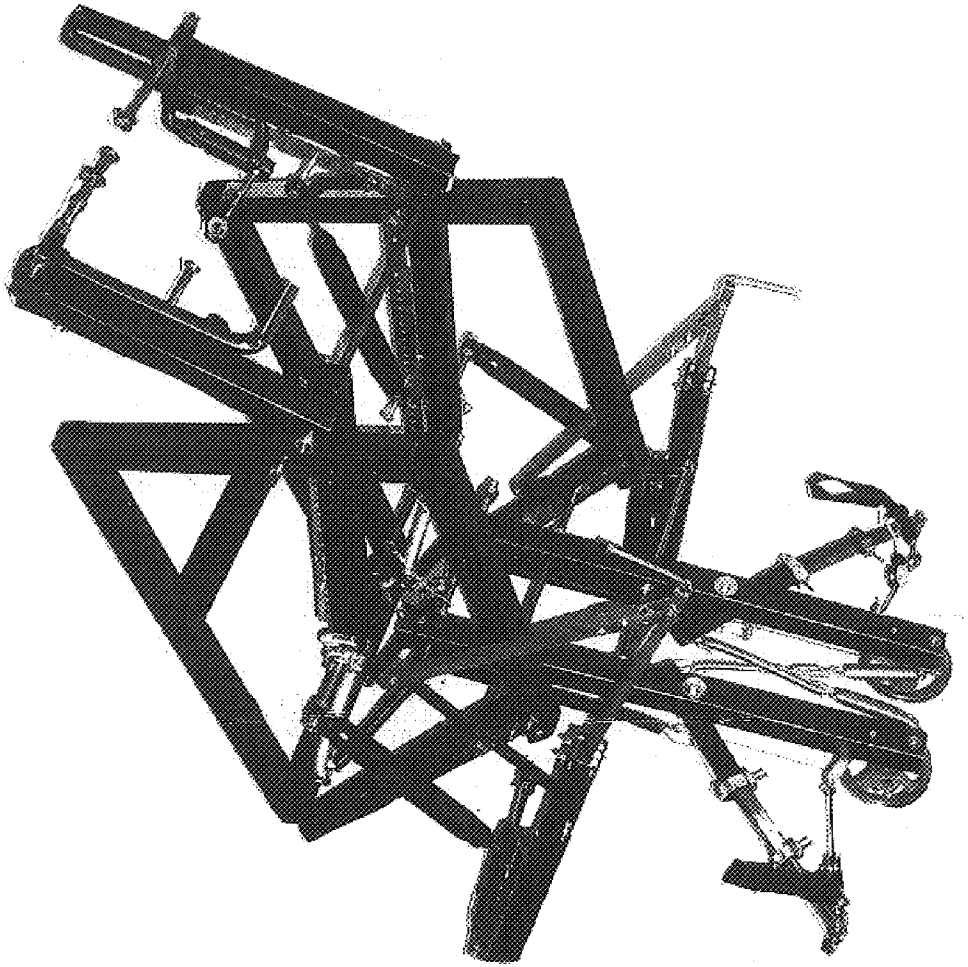

FIG. 7 is a perspective view taken from the users left side of a reclining exercise chair constructed in accordance with the invention showing front, top, and left side of the invention.

Figure 8:
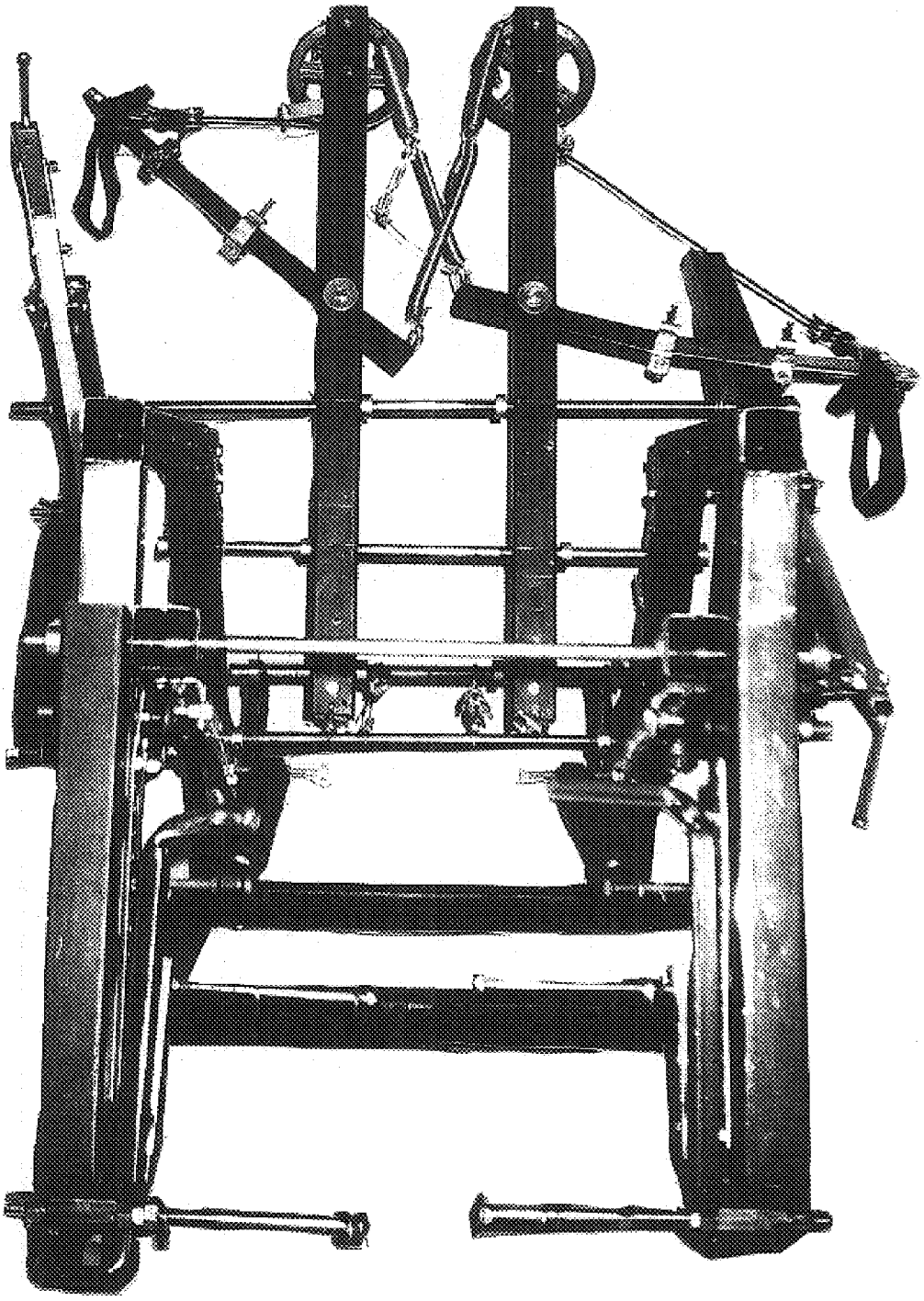

FIG. 8 is a front view of same invention.

Figure 9:
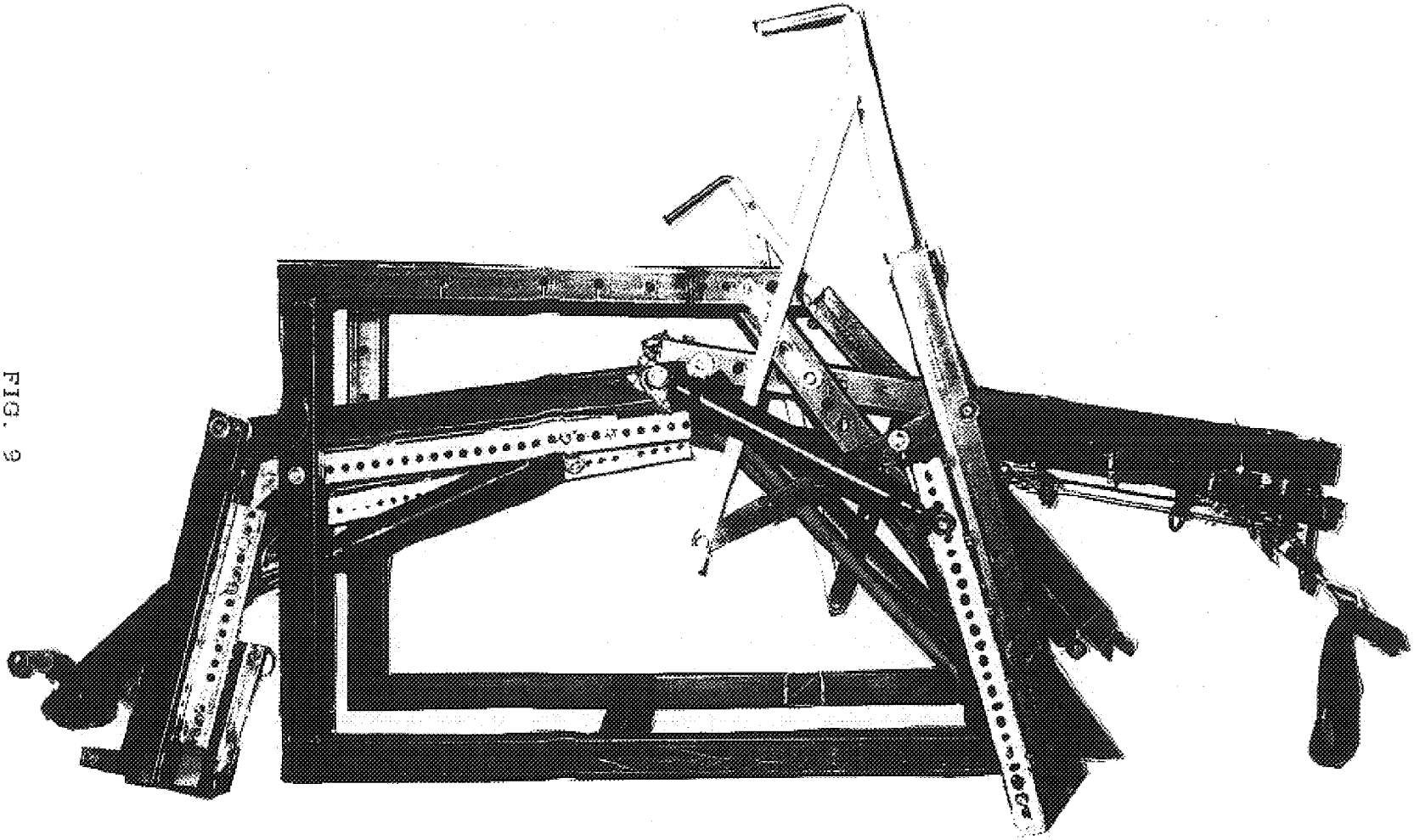

FIG. 9 is a view taken from users left side of same invention. The backrest is shown in the reclining position.

Figure 10:
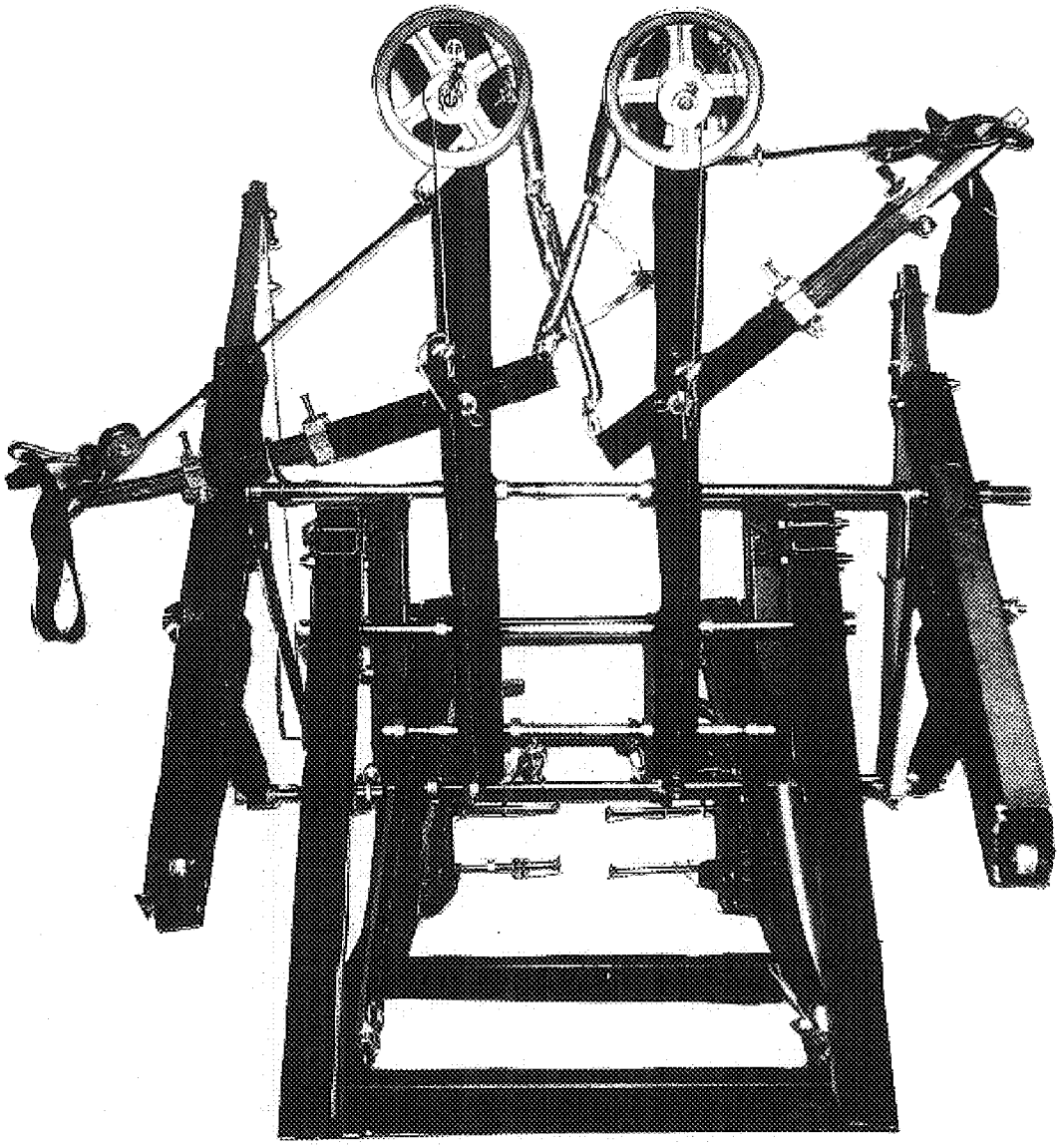

FIG. 10 is a rear view of same invention.

Figure 1:
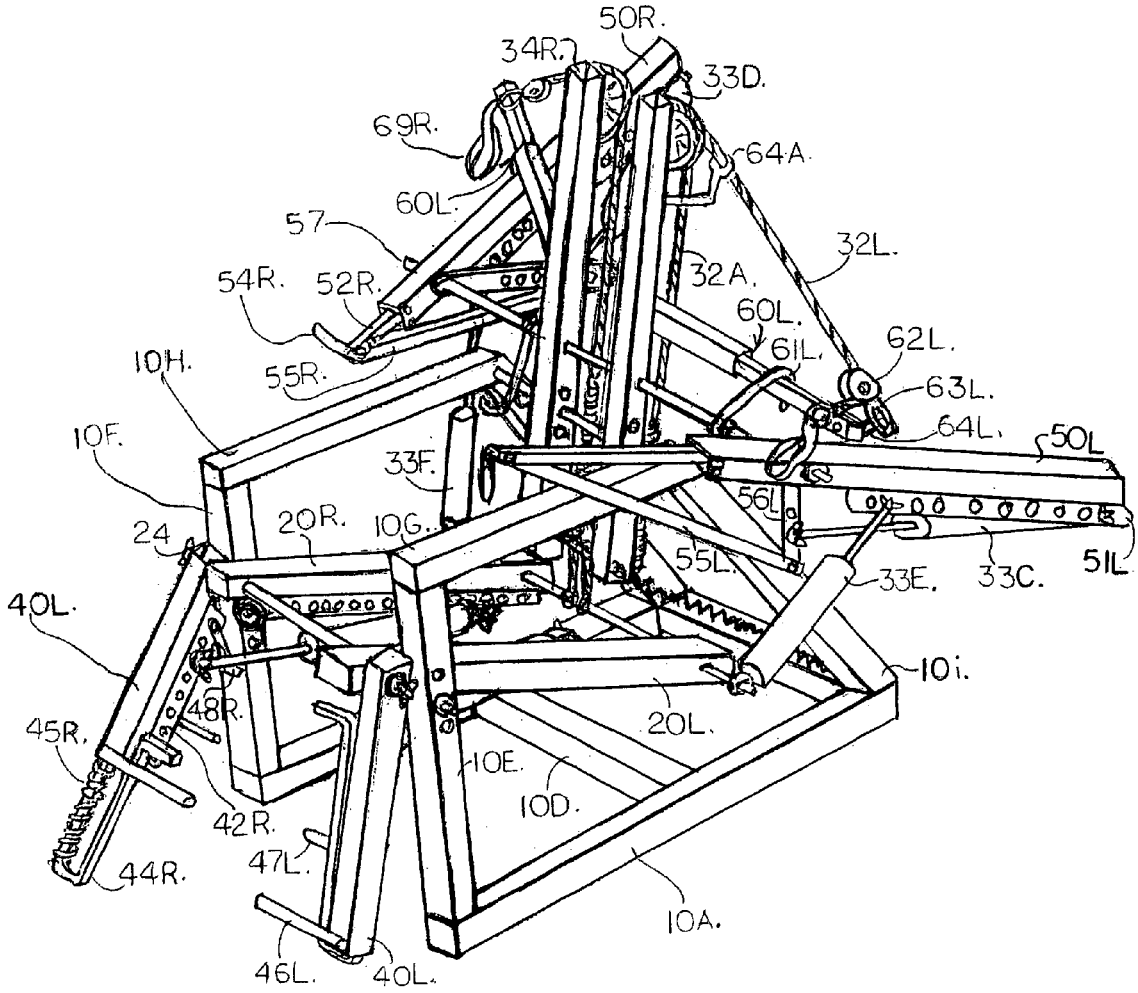
FIG. 1 is a perspective view taken from the users left side of a reclining chair constructed in accordance with the invention showing front, top, and left side of said invention. (Note that right leg press shaft/pedal is extended to expose leg press spring and to show its function).
Figure 2:
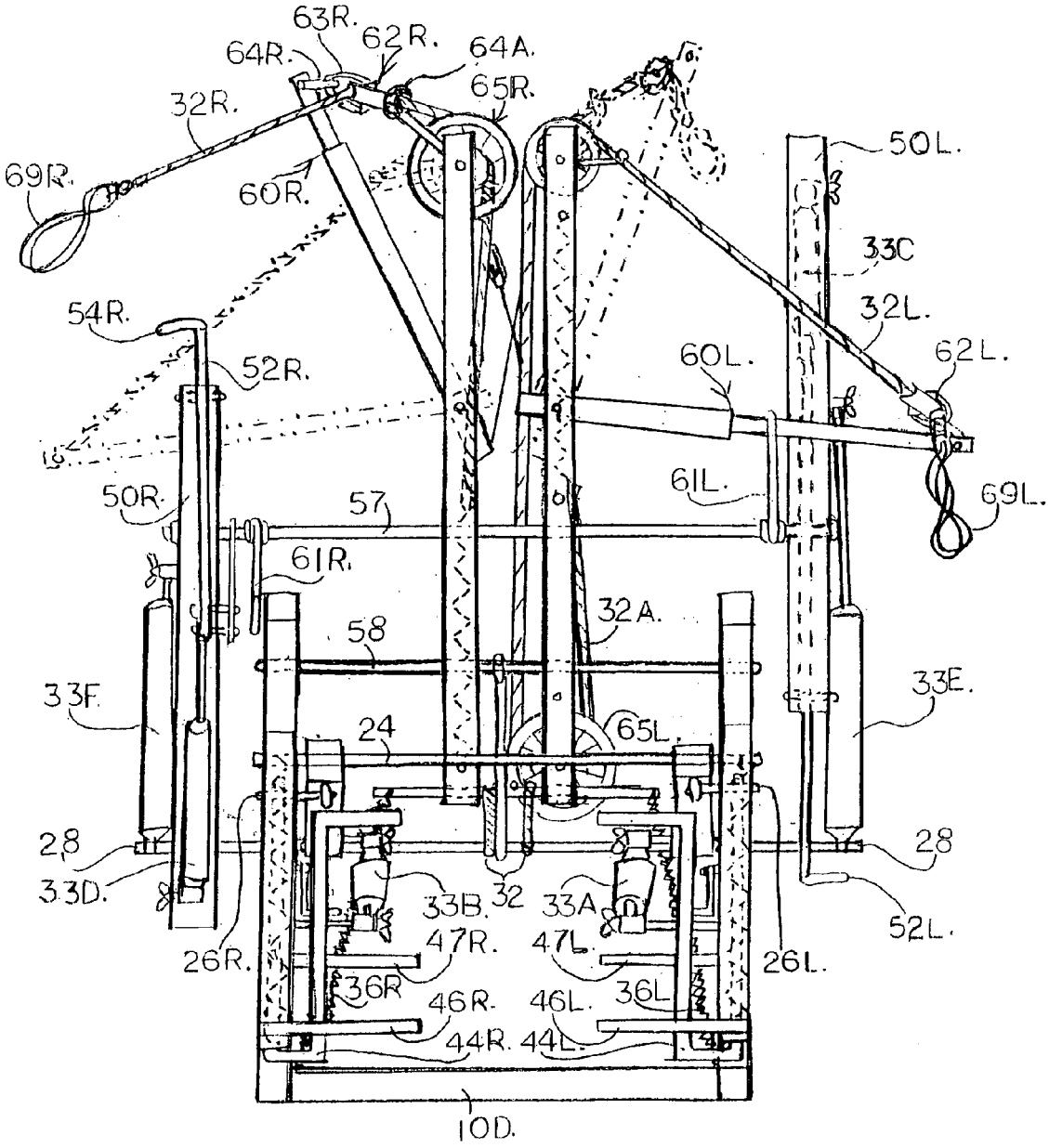
FIG. 2 is a front view of same invetion. (Note that right arm of chair (located at left of FIG. 2) is in up position, and the left arm of same chair (located at right of FIG. 2) is in the down position).
Figure 11:
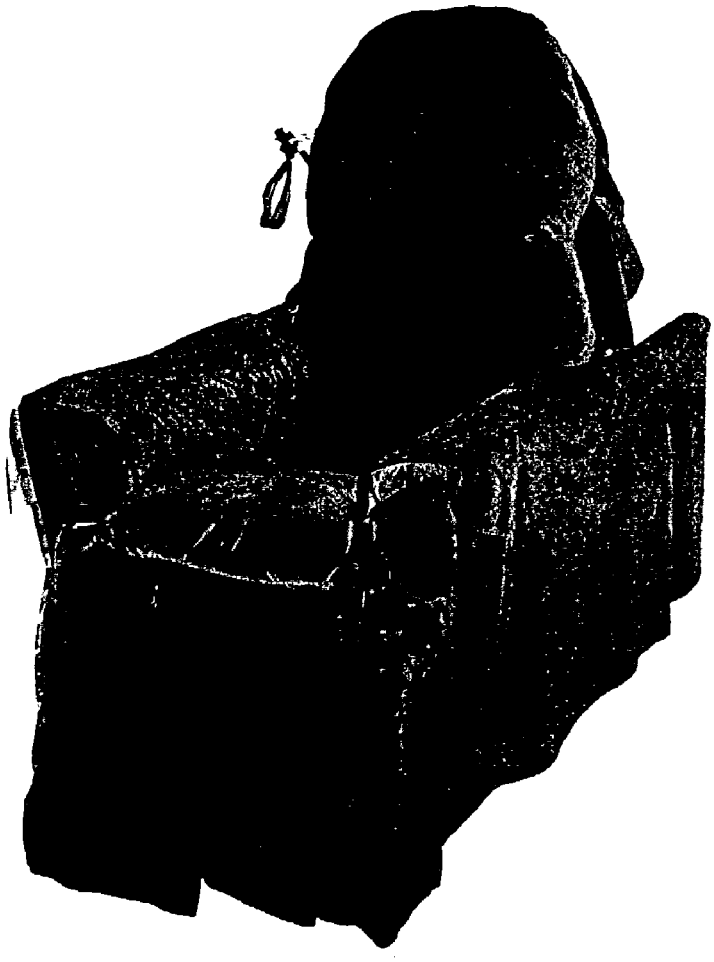
Figure 5:
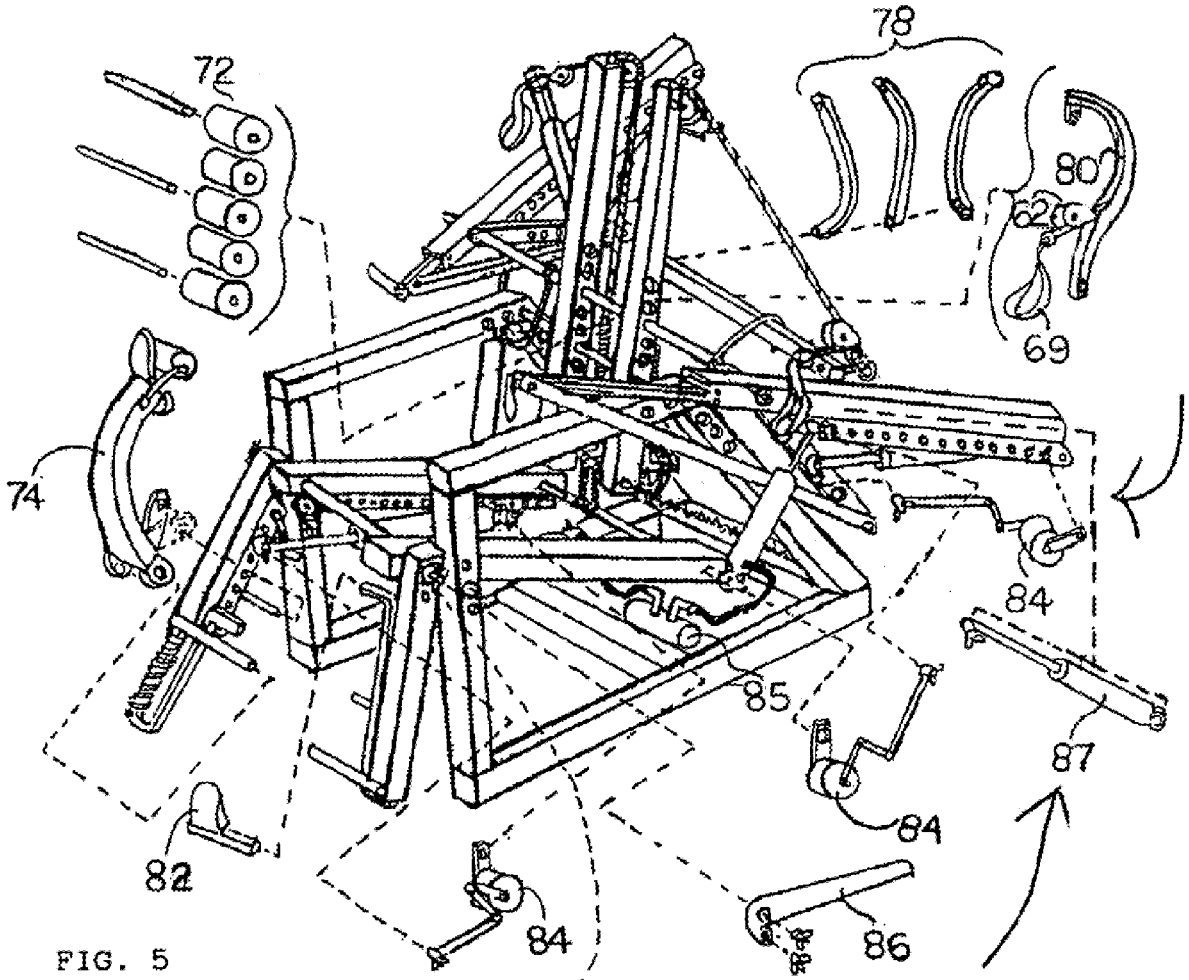
Figure 6:
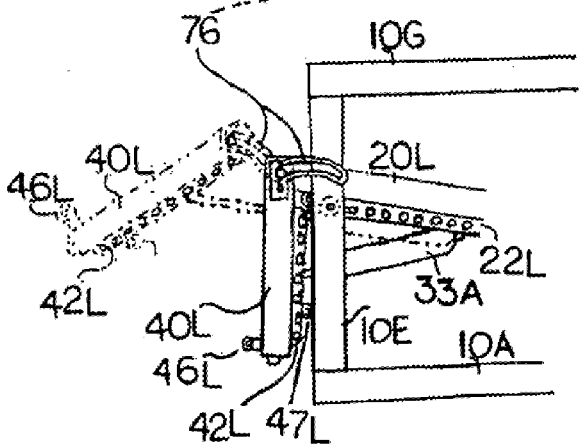

FIG. 11 is the same as FIG. 1 excepting that FIG. 11 shows invention covered with fabric material.

I claim:

1. A reclining exercise chair comprising:

a base member with width, length, and height, substantial enough to support a front vertical member and a rear vertical member with said rear vertical member supporting a horizontally mounted pivot that supports a vertically mounted backrest member with opposite ends including an upper end and a lower end and said front vertical member supporting a horizontally mounted rotary support;

a seat member with a front end and a back end supported on said horizontally mounted rotary support and said back end of said seat member being supported by a horizontally mounted pivot that is supported by said lower end of said backrest member, said base further comprises struts secured on a frame arm assembly at a plurality of adjustment areas of said frame arm assembly.

2. A reclining exercise chair comprising:

a base member with width, length, and height to substantially support a vertical member that supports a pivotally and horizontally mounted rotary support with said rotary support supporting a seat member with a front end and a back end with said front end of said seat member supporting a horizontally mounted pilot with said pivot supporting a leg member with an upper end and a lower end with said upper end of said leg member being supported by a horizontally mounted pivot that is supported by said front end of said seat member and said lower end of said leg member supporting a horizontally mounted lower front and upper rear pair of foot bars mounted at said lower end of said leg member with said foot bars extending horizontally to one side of said leg member; a resistance means with a front end and a back end with said front end of said resistance means being pivotally coupled to said leg member and said back end of said resistance means being pivotally coupled to backrest member, said base further comprises left and right struts secured on a left and right frame arm assembly at a plurality of adjustment areas of said left and right frame arms.

3. A reclining exercise chair comprising:

a base member with width, length, and height to substantially support a vertical member that supports a pivotally and horizontally mounted pivot that Supports a pivotally mounted backrest member and said backrest member supports a horizontally mounted pivot support that extends from left side to right side of said backrest member extending to such a length so that said pivot support that is supported by said backrest member is pivotally coupled to a resistance means with said front end of said resisting means being rotatably coupled to a gripping means and said resistance means pivotally coupled to a second resistance means having an upper end and a lower end with said upper end of said second resistance means being pivotally coupled to said resistance means, and said lower end of said second resistance means being pivotally coupled to a horizontally mounted pivot with said horizontally mounted pivot being supported by the back end of a seat member that is supported by the lower end of said backrest member.

4. A reclining exercise chair comprising:

a base member with width, length, and height to substantially support a pivotally mounted member with opposite ends and said pivotally mounted member supports a resistance means with said resistance means being wound onto a rotary guidance means and said rotary guidance means is rotatably mounted to said pivotally mounted member and said rotary guidance means is connected to a flexible elongate connector having opposite ends with one end of said flexible elongate connector wound onto said rotary guidance means conjointly with said resistance means and said flexible elongate connector is wound onto said rotary guidance means in the opposite direction of said resistance means and said opposite end of said flexible elongate connector is wound onto a second rotary guidance means and said second rotary guidance means is rotatably mounted to a second pivotally mounted member with opposite ends and said second pivotally mounted member is pivotally mounted to first said pivotally mounted member and said opposite end of said flexible elongate connector is fastened to a gripping means.

5. The reclining exercise chair of claim 1 wherein said reclining exercise chair is covered with fabric material and cushions on said pivotaily mounted seat member and said pivotably mounted backrest member and said pivotally mounted arm member and said pivotally mounted leg member.

6. The reclining exercise chair of claim 1 wherein said pivotably mounted seat member, said pivotably mounted backrest member, and said pivotably mounted members can be connected to electric motors, hydraulic, and pneumatic power supplies.

7. The reclining exercise chair of claims 1 wherein said seat member and said pivotably mounted member comprise elongated, perforated flanges that extend lengthwise on said seat member and said pivotably mounted member.

8. The reclining exercise chair of claim 1 wherein said backrest beam supports a plurality of horizontally mounted spindles stacked one above the other wherein each said spindle is covered with a resilient material.

9. The reclining exercise chair of claim 3 wherein said resistance means comprises of aplurality of hydraulic cylinders.

10. The reclining exercise chair of claim 2 wherein said resistance means comprises of a plurality of connectors made of resilient material.

11. The reclining exercise chair of claim 4 wherein said second pivotally mounted member is comprising a plurality of respectively mounted tiers.

12. The reclining exercise chair of claim 4 wherein said second pivotally mounted member is a curvilinear track.

13. The reclining exercise chair of claim 4 wherein said rotary guidance means are selected from a group of at least one of a pulley, cams and spindles.

14. The reclining exercise chair of claim 4 wherein said flexible, elongated, extended, connector means are selected from a group of at least one of a cable, rope, belt, strap and chain.

15. The reclining exercise chair of claim 4 wherein said resistance means comprises a plurality of springs.

16. The reclining exercise chair of claim 4 wherein said resistance means is a plurality of connectors of resilient material.

17. The reclining exercise chair of claim 1 wherein said reclining exercise chair comprises:

(a) a base frame with horizontal members having front ends and back ends and left sides and right sides;

(b) corner members upwardly mounted to said horizontal members of said base frame;

(c) a rear pivot rod support extending and connecting said left rear corner member to right rear corner member;

(d) backrest support members having lower ends and upper ends and front sides and back sides being upwardly mounted to said rear pivot rod support with said lower end of said backrest support members having a horizontally mounted pivot rod extending left to right that pivotally supports a flexible elongate connector that has upper ends and lower ends with said upper end of said flexible elongate connecter pivotally coupled to said horizontally mounted pivot rod that which is pivotally supported by said lower end of said backrest members and said lower end of said flexible elongate connector that is pivotally coupled to a horizontally mounted pivot rod having left ends and right ends extending outward, connecting to back ends of seat support members, and (e) seat support members having front ends and back ends with said back ends of said seat support members being supported by said horizontally mounted pivot rod that is pivotally connected to lower end of said flexible elongate connector and said front ends of said seat support members being supported by a horizontally mounted rotary support means that is supported by said front corner members, said; front end of said seat support members support a horizontally mounted pivot support which pivotally supports leg members each having upper and lower ends and each having substantial horizontally mounted lower front and upper rear pairs of opposite foot bars at said lower ends of said leg members and inwardly extending there from and said foot bars each having an outer layer comprising a resiliently deformable foamed material;

(f) said seat support members underside includes a perforated elongate surface mounted parallel to said seat support members;

(g) said leg members rearward sides include a perforated surface mounted parallel to back side of said leg members;

(h) resistance means with upper ends and lower ends is mounted inside of said leg member and connected to said lower end of said resistance means is a member that extends upward to the inner outside of leg member;

(i) a bidirectional resistance means having front ends and back ends with said front ends of said bidirectional resistance means pivotally coupled to said perforated elongate surface that is mounted to said rearward side of said leg members and said back end of said bidirectional resistance means. being pivotally coupled to said back end of said perforated elongate surface that is mounted to said underside of said seat support members;

j. said backrest members support a horizontally mounted pivot support that extends from left side to said right side of said back rest members and extends to such a length so that said pivot support that is supported by said backrest members is pivotally coupled to arm members that have front ends and back ends with each said arm member being pivotally mounted on said left side and said right side of said backrest members;

k. a perforated elongate surface is mounted parallel to underside of said arm members;

l. a bidirectional resistance means having front ends and back ends with said back ends of said bidrectional resistance means being pivotally coupled to said perforated elongate surface at rear of said underside of said pivotally mounted arm members;

m. said front end of said bidirectional resistance means is pivotally coupled to front end of a vertically mounted perforated lever member haying upper ends and lower ends at one of said perforated areas of said vertically mounted perforated lever member with said upper end of said perforated lever member is pivotally coupled to said pivot support that supports said arm member and said lower end of said perforated lever member is pivotally coupled to a first connecting rod member that has front ends and back ends with said back end of said first connecting rod member being pivotally mounted to said lower end of said perforated elongate lever member and said front end of said first connecting rod member being upwardly extending and pivotally mounted to a second rod member that has front ends and back ends with said front end of said second rod member being placed horizontally and above first said rod member and being pivotally mounted to said front end of said first rod member from above said first rod member and said back end of said second rod member rearwardly extends into said front end of said arm member; sandwiched within horizorntally and vertically rotatably mounted spools that extend from left side to right side and from top to bottom and inside said front end of said arm member;

n. a horizontally and rotatably mounted handle means is connected to said front end of said first connecting rod member;

o. a second bidirectional resistance means having upper ends and lower ends with said lower end of said second bidirectional resistance means pivotally coupled to said horizontally mounted pivot that supports said back ends of said seat support members and upper end of said second bidirectional resistance means being pivotally coupled to said perforated elongate surface that is mounted parallel to said underside of said arm members;

p. said backrest members with said back sides and said lower ends supporting a resistance means having upper ends and lower ends with said lower end of said resistance means being supported by said back side and lower end of said backrest support members and said upper end of said resistance means being support by a lower end of a first flexible elongate connector having upper ends and lower ends with said upper end of said flexible elongate connector being wound around a first rotary guidance means that is mounted to a spindle that is rotatably and horizontally mounted to said upper end of said backrest members and a second rotary guidance means that is mounted under first rotary guidance means onto said spindle;

(q) backrest members with second flexible elongate connector with opposite pairs of ends having one end wound onto second rotary guidance means in the opposite direction of said first flexible elongate connector and the opposite end of said second flexible elongate connector extends laterally outward and being situated through the eye of a cable guide that is horizontally, and pivotally mounted to said back side of said upper end of said backrest members and said second elongate connector extends further in said lateral outward direction and is wound around a rotary guidance means that is rotatably coupled to the outer end of a beam with the other end of said beam being inserted into the end of a hollow beam respectively that is pivotally and horizontally mounted to the back side of said backrest members; below said spindle thereof;

(r) said opposite end of said second flexible elongate connector is fastened to a handle means and said pivot that is supported by said backrest members supports a holding means that is rotataby mounted to said pivot that is supported by said backrest members and said holding means contacts said beams that are respectively rotatably and horizontally mounted to said backside of said backrest members below said first and said second rotary guidance means.

* * * * *

UNITED STATES PATENT AND TRADEMARK OFFICE

CERTIFICATE OF CORRECTION

PATENT NO. : 7,276,018 B2
APPLICATION NO. : 10/269692
DATED : October 2, 2007
INVENTOR(S) : Studdard It is certified that error appears in the above-identified patent and that said Letters Patent is hereby corrected as shown below:

Delete drawing sheet 5, and replace with drawing sheet 5. (attached)

Signed and Sealed this

Eighteenth Day of March, 2008

JON W. DUDAS
*Director of the United States Patent and Trademark Office*